US010265605B1

(12) United States Patent
Mozlin et al.

(10) Patent No.: US 10,265,605 B1
(45) Date of Patent: Apr. 23, 2019

(54) APPARATUS FOR GLIDING OVER SNOW

(71) Applicants: Kyle Mozlin, San Jose, CA (US); Ryan Mozlin, San Jose, CA (US)

(72) Inventors: Kyle Mozlin, San Jose, CA (US); Ryan Mozlin, San Jose, CA (US)

( * ) Notice: Subject to any disclaimer, the term of this patent is extended or adjusted under 35 U.S.C. 154(b) by 0 days.

(21) Appl. No.: 16/121,793

(22) Filed: Sep. 5, 2018

(51) Int. Cl.
*A63C 5/04* (2006.01)
*A63C 10/06* (2012.01)
*A63C 10/10* (2012.01)

(52) U.S. Cl.
CPC ..... *A63C 10/06* (2013.01); *A63C 10/103* (2013.01); *A63C 5/0422* (2013.01); *A63C 2203/40* (2013.01)

(58) Field of Classification Search
CPC ..... A63C 5/02; A63C 5/031
USPC ..... 280/14.25, 14.26, 15, 16, 21.1
See application file for complete search history.

(56) References Cited

U.S. PATENT DOCUMENTS 4,138,128 A * 2/1979 Criss ..... A63C 5/031 280/14.21
4,163,565 A * 8/1979 Weber ..... A63C 5/031 280/14.21
4,194,753 A * 3/1980 Schrishuhn, Jr. ..... A63C 17/26 280/13
4,221,394 A * 9/1980 Campbell ..... A63C 5/031 280/14.25
4,243,238 A * 1/1981 Johnson ..... B62B 13/005 280/16
4,725,069 A * 2/1988 Stampacchia ..... A63C 5/031 280/11.28
4,784,233 A * 11/1988 Favors ..... A63C 5/031 280/14.25
5,249,816 A * 10/1993 Southworth ..... A63C 5/031 280/14.25
5,354,088 A 10/1994 Vetter
5,411,282 A * 5/1995 Shannon ..... A63C 5/031 280/14.24
5,505,474 A * 4/1996 Yeh ..... A63C 5/02 280/87.042
5,613,695 A * 3/1997 Yu ..... A63C 5/031 280/14.24
5,618,051 A * 4/1997 Kobylenski ..... A63C 5/02 280/14.21
D391,613 S * 3/1998 Shannon ..... D21/766
5,799,956 A * 9/1998 Shannon ..... A63C 5/031 280/14.21
5,865,446 A * 2/1999 Kobylenski ..... A63C 5/02 280/14.23
6,053,513 A * 4/2000 Dickinson ..... A63C 5/02 280/14.21
6,270,091 B1 * 8/2001 Smith ..... A63C 5/031 280/14.21

(Continued)

*Primary Examiner* — Jeffrey J Restifo
(74) *Attorney, Agent, or Firm* — Sanchelima & Associates, P.A.; Christian Sanchelima; Jesus Sanchelima

(57) ABSTRACT

An apparatus for gliding over snow is disclosed. The apparatus comprises at least two decks coupled via a swivel arm. Each deck comprises a strap to receive a foot of a user, and a board coupled to the deck via a connector. The user stands on the decks to create swivel-motion with the help of the swivel arm. The swivel-motion created at the deck is transferred to the connector and to the board to create forward momentum and glide the board over the snow.

5 Claims, 5 Drawing Sheets

(56) References Cited

U.S. PATENT DOCUMENTS 6,341,786 B1 * 1/2002 Kermis ..... A63C 5/031 280/14.22
6,481,725 B2 * 11/2002 Chou ..... A63C 5/03 280/14.21
6,616,170 B1 * 9/2003 Quarti ..... A63C 5/02 280/603
6,648,347 B1 * 11/2003 Rieg ..... A63C 5/02 280/14.25
6,648,348 B2 * 11/2003 Link ..... A63C 5/031 280/14.25
6,773,021 B2 * 8/2004 Breuer ..... A63C 5/03 280/14.21
6,789,806 B2 * 9/2004 Santa Cruz ..... A63C 5/03 280/14.21
6,834,867 B2 * 12/2004 Smith ..... A63C 5/031 280/14.21
6,994,359 B1 * 2/2006 Silver ..... B61B 11/004 280/16
7,040,634 B1 * 5/2006 Elkins, Jr. ..... A63C 5/031 280/14.25
7,100,927 B2 * 9/2006 Krent ..... B62B 13/005 280/15
7,159,875 B2 * 1/2007 Seymour ..... A63C 5/02 280/11.18
7,419,179 B2 9/2008 Zanco et al.
7,537,221 B2 * 5/2009 Lasala ..... B62B 13/04 280/11.12
7,581,735 B2 * 9/2009 Birdsell ..... A63C 5/031 280/14.21
7,726,667 B2 * 6/2010 Ferron ..... B62B 13/04 280/16
7,762,564 B2 * 7/2010 Stene-Johansen ..... B62B 13/12 280/15
7,896,365 B2 * 3/2011 Smith ..... A63C 5/03 280/14.21
8,177,241 B1 * 5/2012 Marks ..... B62B 13/046 280/14.28
8,403,342 B1 * 3/2013 McDaniel ..... B62K 13/00 280/21.1
8,579,301 B2 * 11/2013 Smith ..... A63C 5/03 280/14.21
9,174,663 B2 * 11/2015 Reinig ..... B62B 13/12
9,550,107 B1 * 1/2017 Shannon, II ..... A63C 5/06
9,717,976 B2 * 8/2017 Elphick ..... A63C 5/031
9,717,977 B2 * 8/2017 De Loore ..... A63C 5/031
9,724,590 B2 * 8/2017 Reinig ..... A63C 5/06

* cited by examiner

APPARATUS FOR GLIDING OVER SNOW

BACKGROUND OF THE INVENTION

1. Field of the Invention

The present disclosure generally relates to recreational sport devices such a ski board or a snowboard. In particular, the present disclosure relates to an apparatus used for gliding over snow with ease.

2. Description of the Related Art

It is known that ski boards and snowboards are used to slide or glide over snow. The ski board is attached to a foot or shoe of a user. As such, a pair of ski boards is attached to both feet of the user to glide over snow. The snowboard is typically wider than the ski board and a single snowboard is used to secure both feet of the user, which gives the ability to glide over snow.

Several attempts have been made in the past to provide various designs of the ski boards and snowboards. Examples of the ski board and the snowboard were disclosed in at least United States granted patent 7419179B2 and in United States granted patent 5354088A, respectively. In U.S. Pat. No. 7,419,179B2, a ski board with a vertical plane of general symmetry including a body or base that includes at least in a binding zone two hollow lateral recesses extending longitudinally is disclosed. In U.S. Pat. No. 5,354,088A, a snowboard coupling for use between the snowboard and the user boot binding and a quick release from the standing position is disclosed.

Although the above disclosures disclose several designs of the ski boards and snowboards, they have several problems. For instance, novice users cannot use them as it takes considerable time to learn to create forward momentum to glide over snow. Further, the users may have difficulty in carving without having experience in gliding over snow using the snowboard. Furthermore, the users have to wear specific boots to fit into the snowboard whenever they wish to use the snowboards having straps to secure the boots to the snowboard.

Other documents describing the closest subject matter provide for a number of more or less complicated features that fail to solve the problem in an efficient and economical way. None of these patents suggest the novel features of the present invention. Specifically, none of the disclosures in the art disclose an apparatus or a snowboard or a ski board, which can be used by novice users to glide over snow.

Therefore, there is a need in the art for an apparatus for gliding over snow, which can be strapped on to feet of the user and can be used to create forward momentum.

SUMMARY OF THE INVENTION

It is one of the main objects of the present invention to provide an apparatus for gliding over snow and avoids the drawbacks of the prior art.

It is one object of the present invention to provide an apparatus for gliding over snow, which can be strapped on to feet of the user and can be used to create forward momentum. It is one object of the present invention to provide an apparatus comprising straps to hold the feet or shoes of the users firmly while gliding over snow.

It is one object of the present invention to provide an apparatus for gliding over snow with ease. The apparatus comprises at least two decks i.e., a first deck and a second deck coupled via a swivel arm. Each deck e.g., the first deck comprises a strap to receive foot of a user. The apparatus comprises a board coupled to the deck via a connector. The connector is used to transfer the load put on the deck to the board to create forward momentum. The user stands on the decks with his two feet and creates a swivel-motion with the help of the swivel arm. The swivel-motion is transferred to the connector and then to the board to create forward momentum.

The board then glides over the snow.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

The following detailed description is intended to provide example implementations to one of ordinary skill in the art, and is not intended to limit the invention to the explicit disclosure, as one or ordinary skill in the art will understand that variations can be substituted that are within the scope of the invention as described.

The present disclosure discloses an apparatus for gliding over snow. The apparatus comprises at least two decks i.e., a first deck and a second deck coupled via a swivel arm. Each deck e.g., the first deck comprises a strap to receive foot of a user. The apparatus comprises a board coupled to the deck via a connector. For example, the first deck comprises a first board, and a second deck comprises a second board. The connector is used to transfer the load put on the deck to the board to create forward momentum. The user stands on the decks with his two feet and creates a swivel-motion with the help of the swivel arm. The swivel-motion is transferred to the connector and then to the board to create forward momentum. The board then glides over the snow.

Various features and embodiments of an apparatus for gliding over snow are explained in conjunction with the description of FIGS. 1A-9B.

Figure 1A:
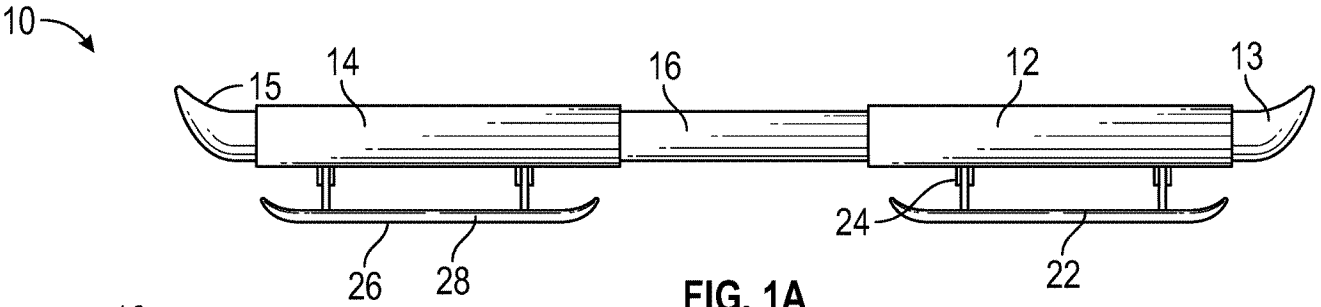
FIGS. 1A, 1B and 1C illustrate a side view, a top view and a bottom view, respectively of an apparatus 10 for gliding over snow, in accordance with one embodiment of the present disclosure.
Figure 1B:
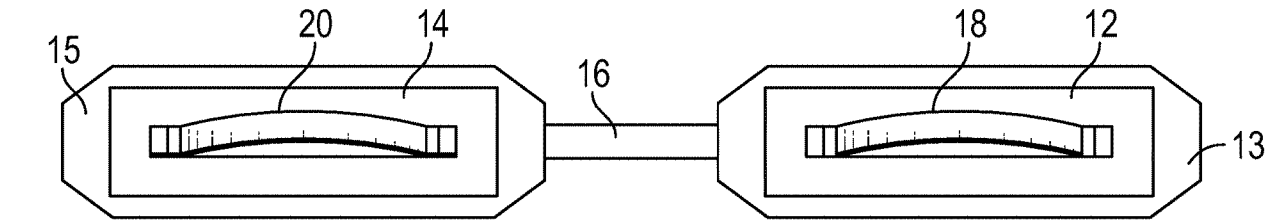
Figure 1C:
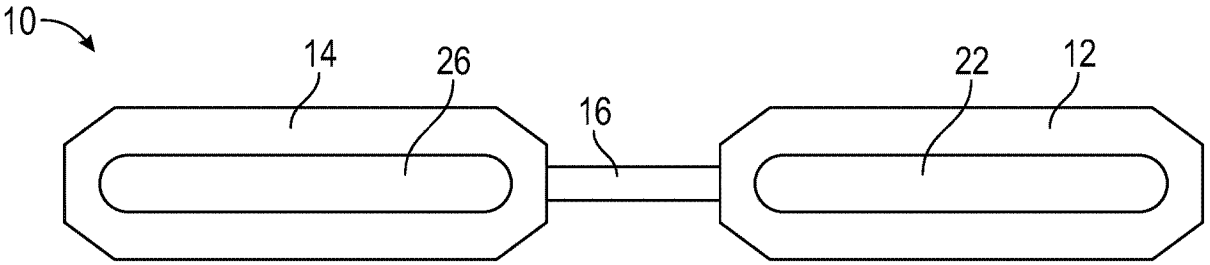

Referring to FIGS. 1A, 1B and 1C, a front view, a top view and a bottom view, respectively of an apparatus 10 for gliding over snow is shown, in accordance with one embodiment of the present disclosure. The apparatus 10 comprises a first deck 12 and a second deck 14. Each of the first deck 12 and the second deck 14 is made of plastic, fiberglass, wood and so on. The first deck 12 and the second deck 14 are provided in a flat or concave structure such that a user may keep one foot on the first deck 12 and another foot on the second deck 14. The first deck 12 comprises a first tip 13 at farther end. Similarly, the second deck 14 comprises a second tip 15 at farther end. As can be seen in at least FIGS. 1A and 1B, the first deck 12 and the second deck 14 are connected using a swivel arm 16. As can be seen, the swivel arm 16 is provided at center of the first deck 12 and the second deck 14. It should be understood that when the user stands on the first deck 12 and the second deck 14 (by keeping one foot on first deck 12 and the second deck 14), the user can create a swivel motion i.e., S-motion. Further, the swivel arm 16 facilitates in grinding on hand or box rails. As such, the swivel arm 16 enables the user to provide different motions to glide in different ways.

As can be seen from FIG. 1B, the first deck 12 comprises a first strap 18. Similarly, the second deck 14 comprises a second strap 20. The first strap 18 and the second strap 20 are used to receive the foot e.g., right foot is received at the first strap 18 and the left foot is received at the second strap 20. The first strap 18 and the second strap 20 are provided with locks (not shown) to hold the foot of the user or to release the foot when not in use. The first strap 18 and the second strap 20 are adjustable, and can lock in place such that the users having different foot or shoe size can use the apparatus 10 for gliding over snow.

Referring to FIG. 1A, the apparatus 10 further comprises a first board 22 coupled to the first deck 12 using a first connector 24. Further, the apparatus 10 further comprises a second board 26 coupled to the second deck 14 using a second connector 28. The first board 22 and the second board 26 may include a ski board, snowboard and so on.

Figure 2A:
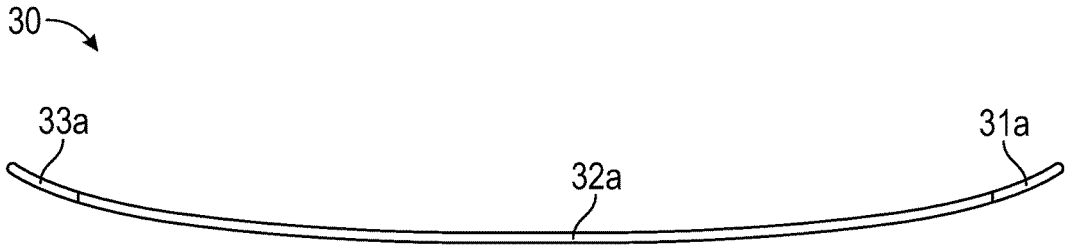
FIGS. 2A, 2B and 2C illustrates a board 30 such a ski board, in accordance with one embodiment of the present disclosure.
Figure 2B:
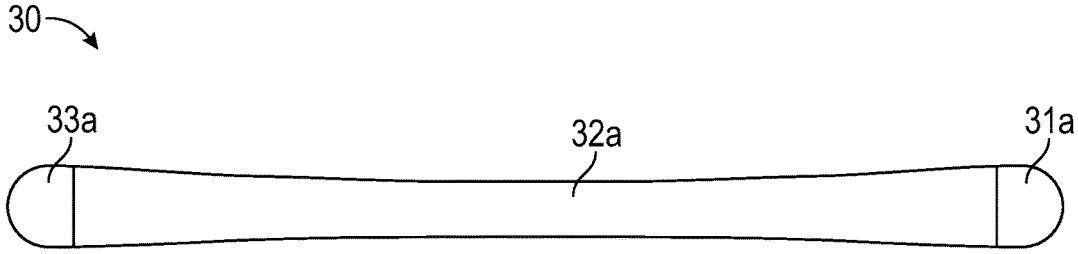

Referring to FIGS. 2A and 2B, a side view and top view of a first board 30 (similar to the first board 22 in FIG. 1A) is shown, in accordance with one embodiment of the present disclosure. The first board 30 comprises a first end 31*a*, a center 32*a* and second end 33*a*. As can be seen from FIG. 2A, the first end 31*a* and the second end 33*a* are raised at an angle as compared to the center 32*a*. The first end 31*a* and the second end 33*a* are raised low to provide steering, pivoting and carving when the first board 30 is used to glide over snow. Specifically, at slow speeds, due to the (lower) raised angle of the first end 31*a* and the second end 33*a*, contact length of the first board 30 with snow is reduced thereby facilitating steering and pivoting easily. Further, at medium speeds, the first end 31*a* and the second end 33*a* engagement with the snow is quicker and results in quick steering and carving. Furthermore, the first end 31*a* and the second end 33*a* may be raised higher such that the edge length and the side cut are enhanced to increase carving, grip and stability for the first board 30. Similar, the second board (not shown) is also provided with ends raised when compared with its center.

Figure 2C:
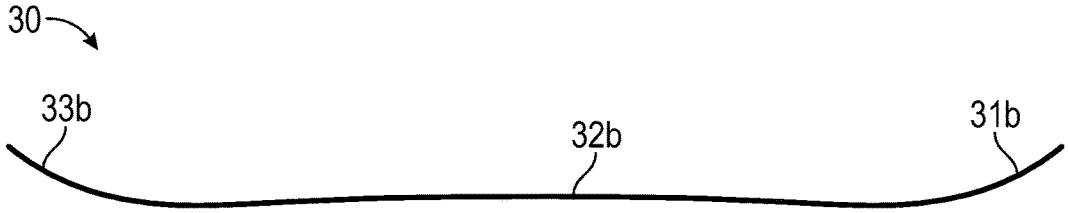

In another example, the first board 30 is provided in the shape shown in FIG. 2C. As can be seen, the first board 30 comprises a first end 31*b*, a center 32*b* and a second end 33*b*. In the current example, the first end 31*b* and the second end 33*b* are raised at an angle. Further, the center 32*b* is raised in convex shape. The first board 30 facilitates in gliding on snow in all conditions. For instance, the first board 30 can be used to float or ski or glide over powder surfaces and gives ability to turn on packed snow. This is because; due to raised shape at the first end 31*b*, the center 32*b* and the second end 33*b*, overall surface of the first board 30 comes in contact with the snow when weight is put onto the first board 30. As a result, the first end 31*b* and the second end 33*b* of the first board 30 don't get buried in the snow and the first board 30 remains above the surface (powder surface) and allows the user to ride easily. Further, the first board 30 allows the user to take sharp and easy turns.

Figure 3:
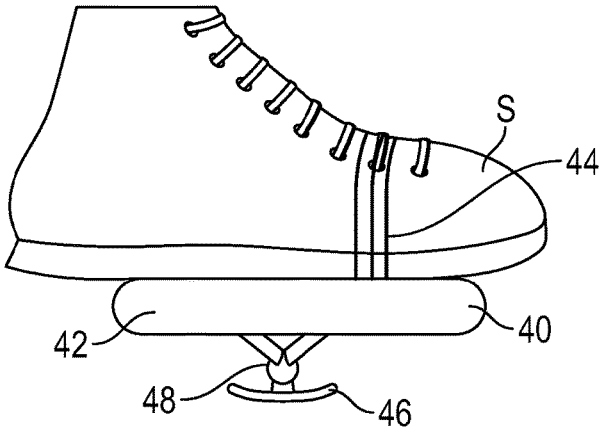
FIG. 3 illustrates a side view of an apparatus 40 comprising a deck 42 and a board 46 coupled via a connector 48, in accordance with one embodiment of the present disclosure.

As explained above, the first deck is coupled to the first board using the first connector. Referring to FIG. 3, a side view of an apparatus 40 used for gliding over snow is shown, in accordance with one embodiment of the present disclosure. The apparatus 40 comprises a first deck 42. The first deck 42 comprises a strap 44 used to strap boot or shoe S of the user. The first deck 42 is coupled to a first board 46 using a first connector 48. It should be understood that the user might place one foot on the first deck 42 and another foot on a second deck (not shown). In order to create forward momentum, the pressure exerted (swivel motion or S-motion) on the first deck 42 needs to be transferred onto the first board 46 for gliding over snow. As such, the first connector 48 plays an important role in transferring the swivel motion applied on the first deck 42 to the first board 46.

Figure 4:
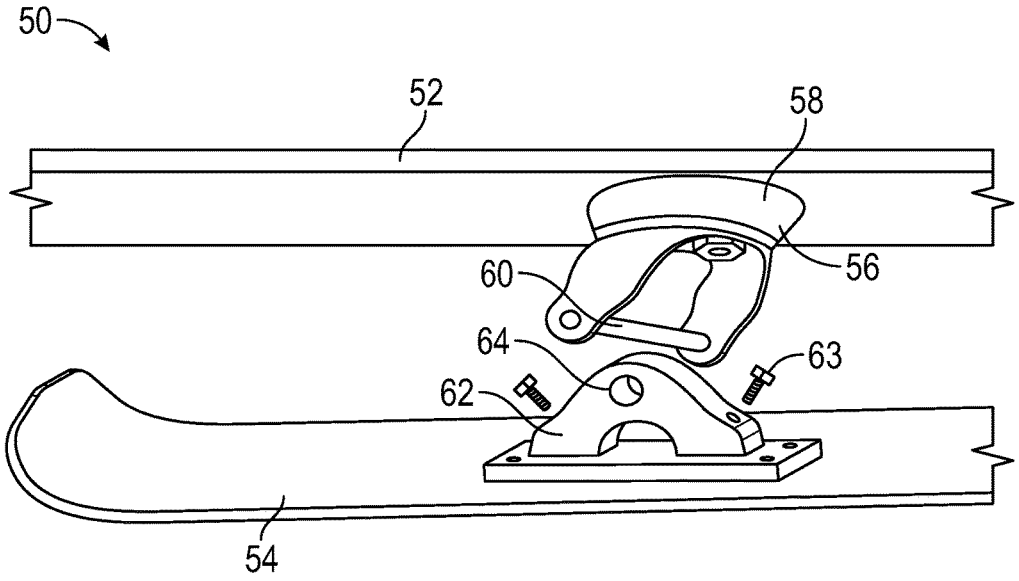
FIG. 4 illustrates a perspective view of an apparatus 50 for gliding over snow, in accordance with one exemplary embodiment of the present disclosure.

Referring to FIG. 4, a perspective view of an apparatus 50 is shown. The apparatus 50 comprises a deck 52, a board 54 and a connector 56. The connector 56 comprises a first section 58 coupled to the deck 52 at underside. In one example, the first section 58 is provided as a caster at an angle of 45 degrees. It should be understood that the first section 58 allows having 360-degree spinning motion due to its pivot caster position. The first section 58 comprises a connecting rod 60. Further, the connector 56 comprises a second section 62 coupled to the board 54. In one implementation, the second section 62 is coupled to the board 54 using screws 63. The second section 62 comprises a hole 64 to receive the connecting rod 60.

In use, when the user stands on the deck 52, the user may apply pressure in swivel motion on the deck 52 to create forward momentum. As a consequence, the first section 58 wields spinning motion based on the amount of the pressure exerted on the deck 52. The spinning motion is transferred to the second section 62 via the connecting rod 60 and the board 54 moves forward. As the first section 58 facilitates in 360 degree spinning motion, the apparatus 50 is used to glide in any angle with ease.

Figure 5:
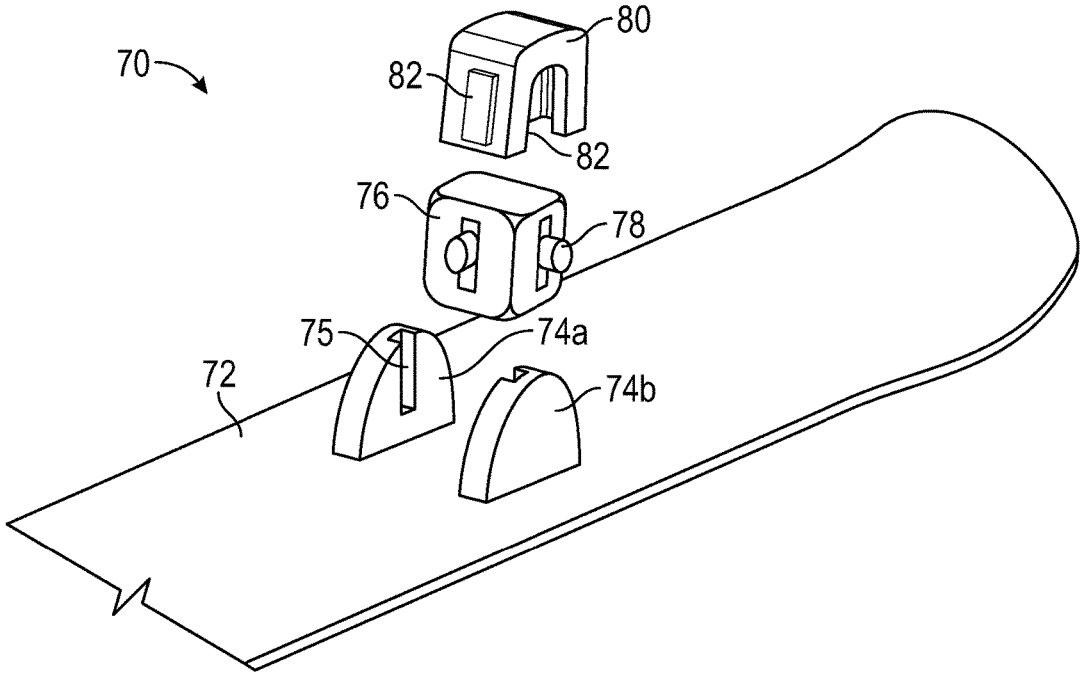
FIG. 5 illustrates a perspective view of a connector 70 coupled to a board 72, in accordance with one exemplary embodiment of the present disclosure.

Referring to FIG. 5, a perspective view of a connector 70 coupled to a board 72 is shown, in accordance with one exemplary embodiment of the present disclosure. The connector 70 comprises at least two first sections 74*a* and 74*b* protruding away from the surface of the board 72. Each of the two first sections 74*a* and 74*b* are provided with a first cut section 75. The first cut section 75 is provided in perpendicular to the board 72. The connector 70 further comprises a second section 76 provided in a square shape. The second section 76 comprises fins 78 protruding out from mid-section at each side face of the second section 76. In other words, the second section 76 comprises fins 78 provided at four sides. Each of the fins 78 is projecting outwards from the second section 76. Further, the connector 70 comprises a third section 80 provided in U-shape. The third section 80 comprises a plurality of second cut sections 82 provided at interior surface of the third section 80. Each of the second cut sections 82 is provided in perpendicular to the board 72. It should be understood that upper end of the U-shaped third section 80 is coupled to the underside of the deck (not shown, similar to the first deck 12 in FIG. 1A).

At first, two fins 78 of the second section 76 are placed in the first cut section 75 provided in the first sections 74*a* and 74*b*. Subsequently, two fins 78 of the second section 76 are placed in the second cut sections 82 provided in the third section 80. In use, when the user stands on the deck, swivel motion created by the user is transferred to the third section 80. The third section 80 transfers the swivel motion to the second section 76, then to the first sections 74*a* and 74*b* and then to the board 72. The third section 80 allows the second section 76 to pivot in left and right direction and the first sections 74*a* and 74*b* allow the second section 76 to pivot in front and back direction. As a result, user can swivel in any angle or direction on the deck to create forward momentum at the board 72.

Figure 6:
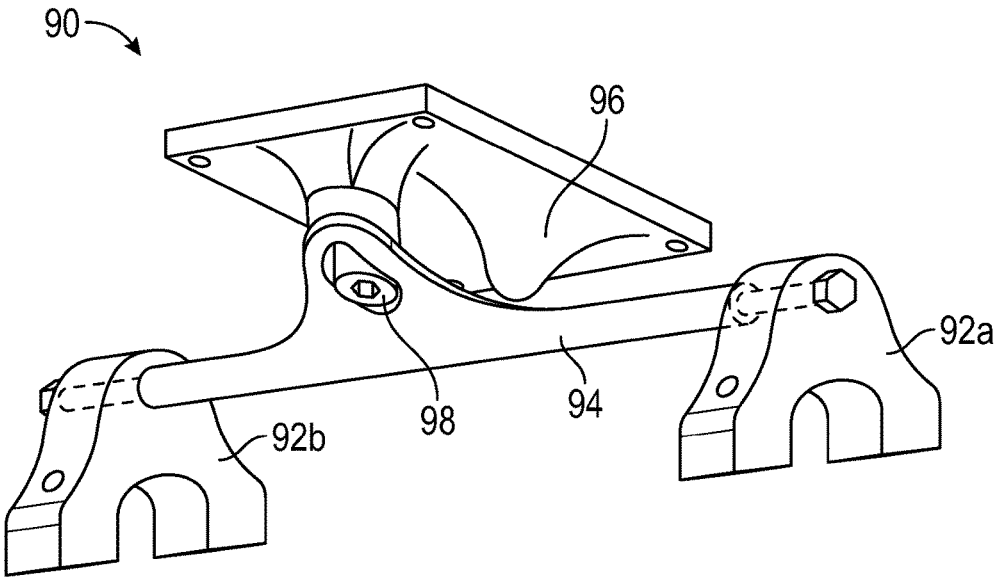
FIG. 6 illustrates a perspective view of a connector 90, in accordance with one exemplary embodiment of the present disclosure.

Referring to FIG. 6, a perspective view of connector 90 is shown, in accordance with one exemplary embodiment of the present disclosure. The connector 90 can be used with the apparatus shown in FIGS. 1A, and 3. The connector 90 comprises at least two first sections 92*a* and 92*b*. In one implementation, the first sections 92*a* and 92*b* are coupled to the board (not shown, similar to the first board 22 in FIG. 1A). The first sections 92*a* and 92*b* are coupled using a second section 94. Further, the second section 94 is coupled to a third section 96 via a link 98. It should be understood that the third section 96 is coupled to a deck (not shown, similar to the first deck 12 in FIG. 1A) at underside. In use, the user may exert swivel motion by standing on the deck. The swivel motion or pressure is received at the third section 96 and it is transferred to the board (not shown) via the second section 94 and the first sections 92*a* and 92*b*.

Figure 7:
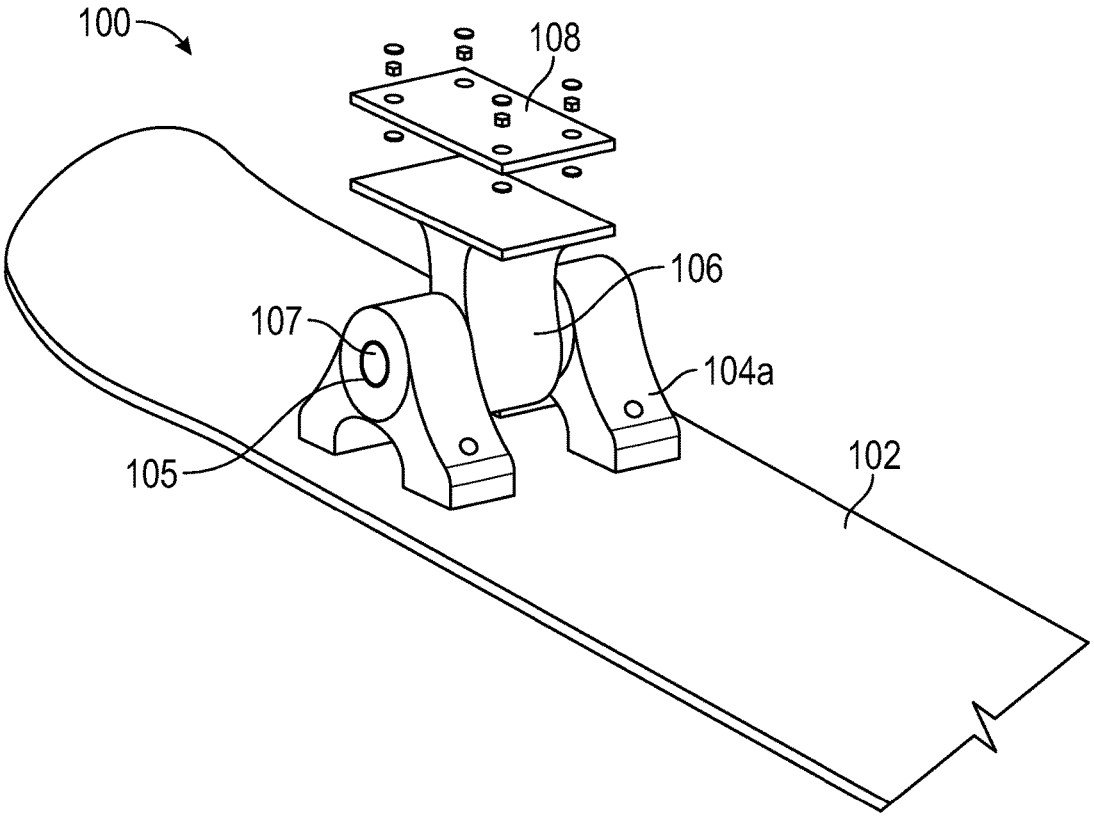
FIG. 7 illustrates a perspective view of a connector 100, in accordance with one exemplary embodiment of the present disclosure.

Referring to FIG. 7, a perspective view of a connector 100 coupled to a board 102 is shown, in accordance with one exemplary embodiment of the present disclosure. The connector 100 comprises at least two first sections 104*a* and 104*b* protruding away from the surface of the board 102. The first sections 104*a* and 104*b* comprises a hole 105. The connector 100 further comprises a second section 106 having a connecting rod 107. The connecting rod 107 is placed inside the hole 105 to couple the first sections 104*a* and 104*b* with the second section 106. The second section comprises a plate 108 used to couple the second section 106 to a deck (not shown, similar to the first deck 12 in FIG. 1A). In use, the user may exert pressure by standing on the deck. The pressure is received at the second section 106 is transferred to the board 102 via the first sections 104*a* and 104*b*.

Figure 8:
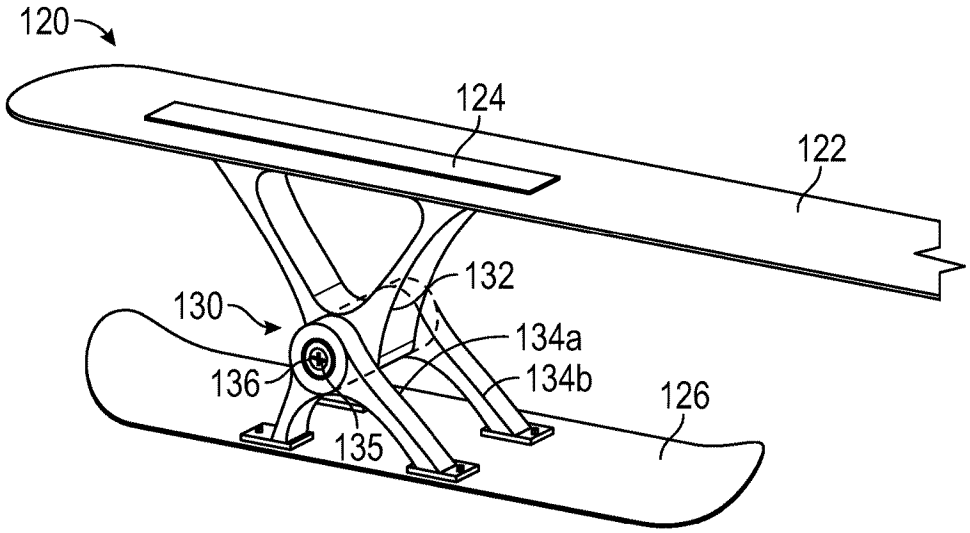
FIG. 8 illustrates a perspective view of an apparatus 120 for gliding over snow, in accordance with one exemplary embodiment of the present disclosure.

Referring to FIG. 8, a perspective of an apparatus 120 is shown, in accordance with one embodiment of the present disclosure. The apparatus 120 comprises a deck 122 provided in a flat structure. The deck 122 comprises a strap 124 to receive shoe or foot of the user. The deck 122 is coupled to a board 126 via a connector 130. The connector 130 comprises a first section 132 provided in a V-shape. Open ends of the first section 132 are coupled to the deck 122 at underside of the deck 122. Further, the connector 130 comprises a plurality of second sections 134*a* and 134*b*. The second sections 134*a* and 134*b* are coupled to the board 126. The second sections 134*a* and 134*b* comprises a hole 135. The first section 132 and the second sections 134*a* and 134*b* are coupled by placing a connecting rod 136 in the hole 135. In use, the user may exert pressure (swivel motion) by standing on the deck 122. The pressure is received at the first section 132 is transferred to the board 126 via the second sections 134*a* and 134*b*. It should be understood that the connector 130 is used to transfer the swivel motion created on the deck 122 to the board 126 such that the forward momentum is created at the board 126 and the apparatus 120 moves in the forward direction.

Figure 9B:
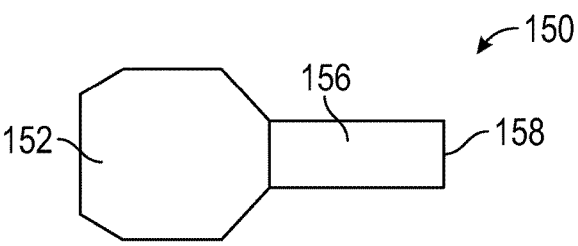
FIGS. 9A and 9B illustrate an apparatus 150 for gliding over snow comprising a toggle 158 at a swivel arm 156, in accordance with one embodiment of the present disclosure.
Figure 9A:
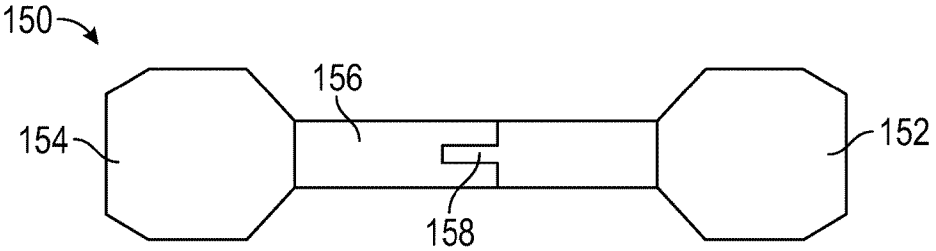

In one implementation, the apparatus described above can be folded and carried from one place to another. Referring to FIGS. 9A and 9B, an apparatus 150 for gliding over snow is shown. The apparatus 150 comprises a first deck 152 and a second deck 154. The first deck 152 and the second deck 154 are coupled via a swivel arm 156. In accordance with the current embodiment, the swivel arm 156 is provided with a toggle 158 at its length, preferably at its center. The toggle 158 is operated to fold the apparatus 150. Specifically, the toggle 158 is operated such that when folded, the first deck 152 sits on top of the second deck 154 as shown in FIG. 9B. After folding, the length of the apparatus 150 reduces and it becomes easy to carry the apparatus 150 from one place to another.

It can be understood from the above description that novice users can use the apparatus. The users can stand on the two decks and tighten the straps. In order to glide e.g., glide on a downhill or terrain; the user can create a swivel motion using the foot with the help of the swivel arm. The swivel motion is transferred to the board via the connector. The swivel motion transferred to the board creates a forward momentum and the user will be able to glide over snow. The above disclosure makes it easier for users to glide or carve with ease. The users may tighten their foot or shoe on the deck by adjusting the length of the strap.

Further, it is to be understood that the apparatus may be provided in various shapes and sizes. For example, the shape of the decks may be provided in square, rectangular or any other shape. The length of the swivel arm can be provided based on need and terrain used for gliding. Further, the length and shape of the board may be chosen as may be needed. The obvious variants of the components disclosed above are considered to be within scope of the current disclosure.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An apparatus for gliding over snow, the apparatus comprising:

at least two decks coupled via a swivel arm, each deck comprising:

a strap to hold a foot of a user; and a board coupled to the decks via a connector, wherein the board is placed on snow, wherein the user stands on the decks to create a swivel-motion, and wherein the swivel-motion created at the deck with the help of the swivel arm is transferred to the connector and to the board to create forward momentum and glide the board over the snow, wherein the connector comprises at least two first sections a second section, and a third section, wherein the first sections are coupled to the board, and wherein the second section is coupled to the deck, wherein the two first sections and the third section comprise cut sections, wherein the second section comprises a plurality of fins operably coupled to the cut sections provided in the two first sections and the third section, and wherein the swivel motion created at the deck is transferred to the third section, the second section, to the first sections, and to the board to glide the board over the snow.

2. The apparatus of claim 1, wherein the board comprises a first end, a center and second end, wherein the first end and the second end are raised at an angle to provide steering, pivoting and carving when the board glides over the snow.

3. The apparatus of claim 1, wherein the connector comprises a first section and a second section, wherein the first section is coupled to the deck, wherein the second section is coupled to the board, and wherein the first section and the second section are coupled using a connecting rod.

4. The apparatus of claim 3, wherein the first section is provided as a caster at an angle of 45 degrees to facilitate 360 degree spinning motion, such that the spinning motion created at the deck is transferred to the second section via the connecting rod in order to move the board forward.

5. The apparatus of claim 1, wherein the swivel arm comprises a toggle to facilitate folding of the swivel arm.

* * * * *